US011750977B2

(12) United States Patent
Du et al.

(10) Patent No.: US 11,750,977 B2
(45) Date of Patent: Sep. 5, 2023

(54) BASKET ASSEMBLY, AUDIO UNIT AND ELECTRONIC DEVICE

(71) Applicant: BEIJING XIAOMI MOBILE SOFTWARE CO., LTD., Beijing (CN)

(72) Inventors: Na Du, Beijing (CN); Zhuofei Ma, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 17/557,354

(22) Filed: Dec. 21, 2021

(65) Prior Publication Data

US 2022/0408191 A1 Dec. 22, 2022

(30) Foreign Application Priority Data

Jun. 16, 2021 (CN) ..... 202110666152.5

(51) Int. Cl.
*H04R 9/02* (2006.01)
*H04R 7/16* (2006.01)

(52) U.S. Cl.
CPC ..... *H04R 9/02* (2013.01); *H04R 7/16* (2013.01); *H04R 2400/11* (2013.01)

(58) Field of Classification Search
CPC ..... H04R 9/02; H04R 7/16; H04R 2400/11
See application file for complete search history.

(56) References Cited

U.S. PATENT DOCUMENTS

2005/0180593 A1* 8/2005 Kajiwara ..... H04R 9/06 381/396
2015/0189442 A1 7/2015 Zhang et al.

FOREIGN PATENT DOCUMENTS

CN 109495819 A 3/2019
WO WO 2017157329 A1 9/2017
WO WO-2017157329 A1 * 9/2017 ..... H04R 31/00

OTHER PUBLICATIONS

European Patent Application No. 21217886.7, Search and Opinion dated Jun. 21, 2022, 10 pages.

* cited by examiner

*Primary Examiner* — Sunita Joshi
(74) *Attorney, Agent, or Firm* — Cozen O'Connor

(57) ABSTRACT

A basket assembly, an audio unit and an electronic device. The basket assembly is applied to an audio unit with a voice coil and includes a basket body. The basket body includes: a metal portion, a plastic portion coupled to the metal portion; and a conductive member embedded in the plastic portion and forming a first contact and a second contact exposed out of the plastic portion, the first contact is configured to be electrically coupled to the voice coil of the audio unit, the second contact is configured to be electrically coupled to a target circuit, and the target circuit includes an audio signal input circuit or an audio signal output circuit.

19 Claims, 5 Drawing Sheets

BASKET ASSEMBLY, AUDIO UNIT AND ELECTRONIC DEVICE

CROSS-REFERENCE TO RELATED APPLICATION

The present disclosure is based on and claims priority to Chinese Patent Application No. 202110666152.5, field on Jun. 16, 2021, the entire content of which is incorporated herein by reference.

TECHNICAL FIELD

The present disclosure relates to a field of terminal technology, and more particularly, to a basket assembly, an audio unit and an electronic device.

BACKGROUND

Currently, mobile terminals are usually equipped with audio units, through which audio power amplification or sound recording of the mobile terminals are achieved. In the related art, a vibration system is adopted to drive a diaphragm to vibrate, and then sound may be made through the vibration of the diaphragm.

In the related art, the audio unit usually includes a metal basket or a plastic basket. However, when the metal basket is adopted, because a conductive circuit that conducts a voice coil is arranged on a voice diaphragm and the voice diaphragm is coupled to the metal basket, there is a risk of short circuit. Also, insulation effect is not good. When the plastic basket is adopted, although the insulation performance is improved, heat dissipation effect is not good and temperature rise of the audio unit increases.

SUMMARY

The present disclosure provides a basket assembly, an audio unit and an electronic device to solve the defects in a related art.

According to a first aspect of the embodiments of the present disclosure, provided is a basket assembly applied to an audio unit with a voice coil. The basket assembly includes a basket body, the basket body including:

a metal portion, a plastic portion coupled to the metal portion; and a conductive member embedded in the plastic portion and forming a first contact and a second contact exposed out of the plastic portion, the first contact being configured to be electrically coupled to the voice coil of the audio unit, the second contact being configured to be electrically coupled to a target circuit, the target circuit including an audio signal input circuit or an audio signal output circuit.

According to a second aspect of the embodiments of the present disclosure, provided is an audio unit, including:

a voice coil;

a basket assembly applied to an audio unit with a voice coil, including a basket body, and the basket body including:

a metal portion, a plastic portion coupled to the metal portion; and a conductive member embedded in the plastic portion, and forming a first contact and a second contact exposed out of the plastic portion, the first contact being configured to be electrically coupled to the voice coil of the audio unit, the second contact being configured to be electrically coupled to a target circuit, the target circuit including an audio signal input circuit or an audio signal output circuit; the basket body of the basket assembly being arranged around the voice coil;

a diaphragm, a same side of the diaphragm being coupled to the basket body and the voice coil, respectively; and a conductive path arranged on a surface of the diaphragm facing the voice coil, one end of the conductive path being electrically coupled to the voice coil, the other end being conducted to the first contact of the conductive member.

According to a third aspect of the embodiments of the present disclosure, an electronic device is provided and includes:

a housing including a sound outlet; and a audio unit arranged in the housing, wherein the audio unit includes:

a voice coil;

a basket assembly applied to an audio unit with a voice coil, including a basket body, and the basket body including:

a metal portion, a plastic portion coupled to the metal portion; and a conductive member embedded in the plastic portion, and forming a first contact and a second contact exposed out of the plastic portion, the first contact being configured to be electrically coupled to the voice coil of the audio unit, the second contact being configured to be electrically coupled to a target circuit, the target circuit including an audio signal input circuit or an audio signal output circuit; the basket body of the basket assembly being arranged around the voice coil;

a diaphragm, a same side of the diaphragm being coupled to the basket body and the voice coil, respectively; and a conductive path arranged on a surface of the diaphragm facing the voice coil, one end of the conductive path being electrically coupled to the voice coil, the other end being conducted to the first contact of the conductive member;

wherein the diaphragm is arranged facing the sound outlet.

It may be understood that the above general description and the following detailed description are merely exemplary and explanatory, and are not construed to limit the present disclosure.

BRIEF DESCRIPTION OF THE DRAWINGS

The drawings here are incorporated into the description and constitute a part of the description. The drawings show embodiments that conform to the present disclosure, and are used together with the description to explain the principle of the present disclosure.

DETAILED DESCRIPTION

Embodiments will be described in detail herein and examples of the embodiments are illustrated in the accompanying drawings. When the description below concerns the drawings, same numbers in different drawings represent same or similar elements unless indicated otherwise. In the following embodiments, the embodiments illustrated do not represent all embodiments consistent with the present disclosure. Instead, they are merely examples of devices and methods consistent with some aspects of the present disclosure as detailed in the appended claims.

The terms used in the present disclosure are merely for the purpose of describing specific embodiments, which are not intended to limit the present disclosure. As used in the descriptions and the appended claims of the present disclosure, "a" "said" and "the" in singular forms mean including plural forms, unless clearly indicated in the context otherwise. It should also be understood that, as used herein, the term "and/or" represents and contains any and all possible combinations of one or more associated listed items.

It should be understood that, although terms such as first, second and third are used herein for describing various kinds of information in this disclosure, such information should not be limited to these terms. These terms are only used for distinguishing the same type of information from each other. For example, without departing from the scope of this disclosure, a first information may also be called as a second information, and similarly, the second information may also be called as the first information. Depending on the context, the term "if" may be construed to mean "when" or "upon" or "in response to determining".

Figure 1:
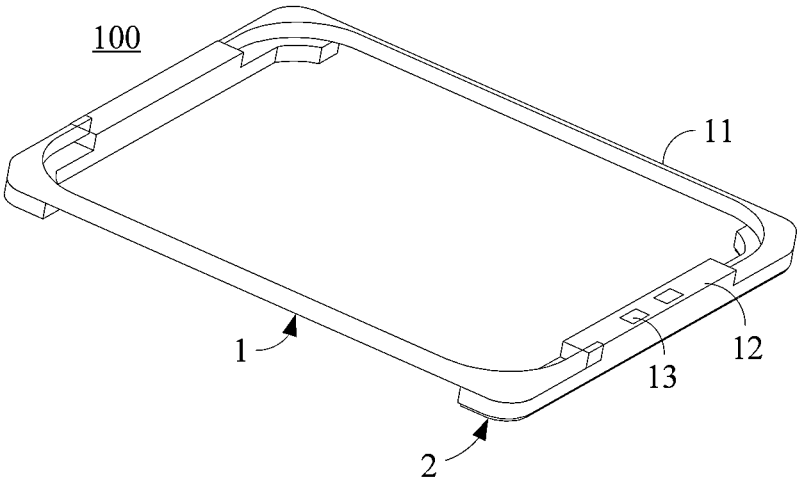
FIG. 1 is a schematic view of a basket assembly according to an embodiment.
Figure 2:
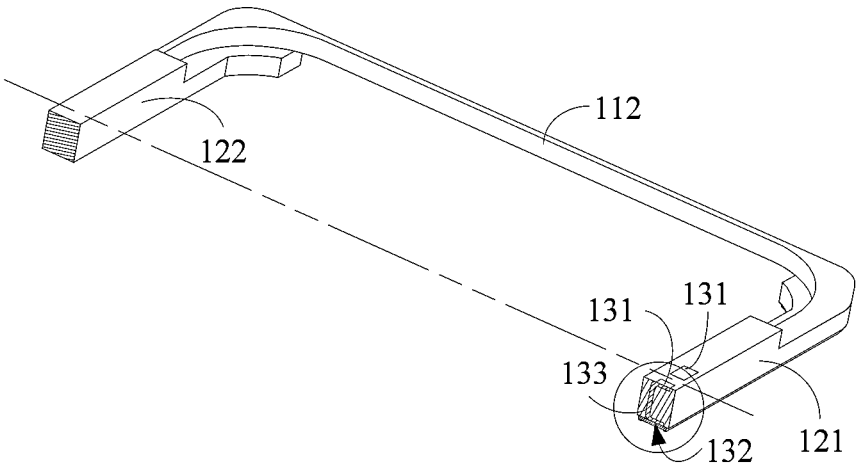
FIG. 2 is a schematic cross-sectional view of the basket assembly in FIG. 1.
Figure 3:
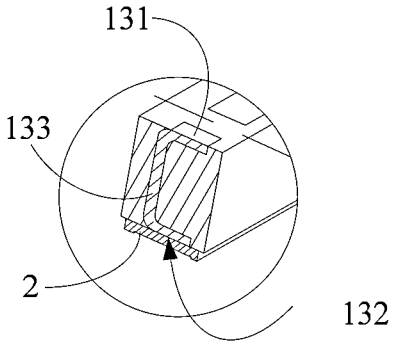
FIG. 3 is a partially enlarged view in FIG. 2.
Figure 4:
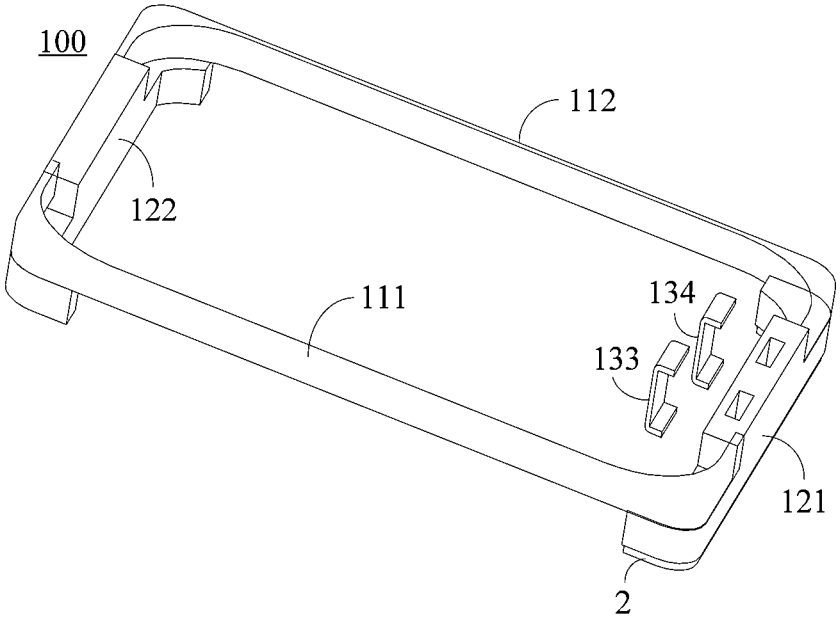
FIG. 4 is an exploded view of the basket assembly in FIG. 1.
Figure 5:
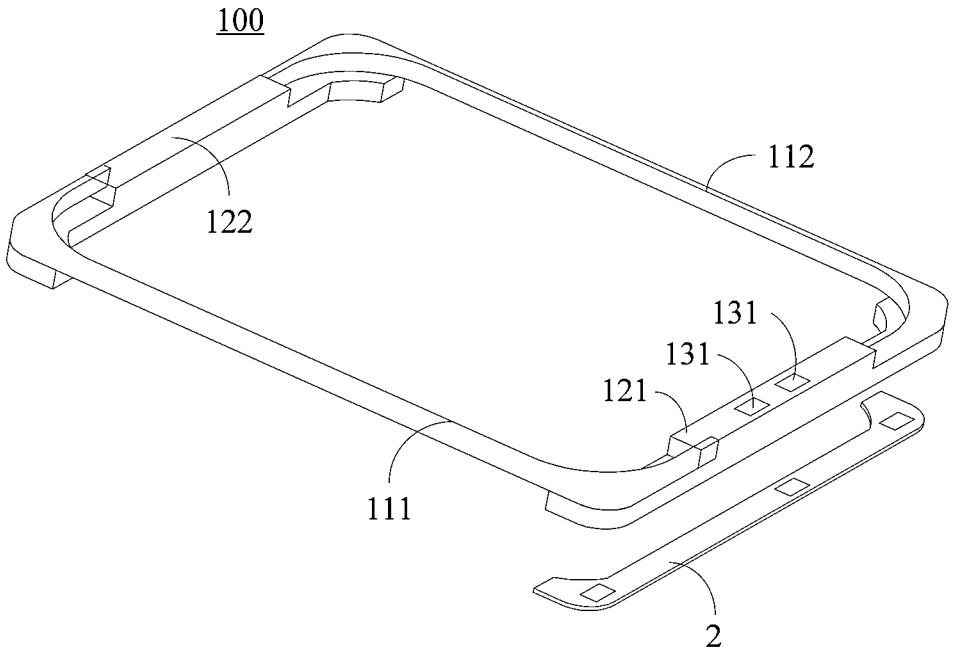
FIG. 5 is another exploded view of the basket assembly in FIG. 1.

FIG. 1 is a schematic view of a basket assembly 100 according to an embodiment. FIG. 2 is a cross-sectional view of the basket assembly 100 in FIG. 1. FIG. 3 is a partially enlarged view in FIG. 2. FIG. 4 is an exploded view of the basket assembly 100 in FIG. 1. FIG. 5 is another exploded view of the basket assembly 100 in FIG. 1. The basket assembly 100 as illustrated in FIGS. 1 to 3 may be applied to an audio unit with a voice coil. The basket assembly 100 may include a basket body 1 and a circuit board 2, and the basket body 1 may include a metal portion 11, a plastic portion 12, and a conductive member 13. The metal portion 11 and the plastic portion 12 are coupled. The conductive member 13 may be embedded in the plastic portion 12. For example, the conductive member 13 and the plastic portion 12 may be injection-molded. The conductive member 13 may include a first contact 131 and a second contact 132 exposed out of the plastic portion 12, the first contact 131 may be electrically coupled to the voice coil of the audio unit 200, and the second contact 132 may be electrically coupled to a target circuit. When the audio unit is configured with different functions, different target circuits are provided. For example, when the audio unit is configured as a speaker subunit, the target circuit may include an audio signal input circuit, and an audio signal input from the audio signal input circuit may be transmitted to the voice coil via the second contact 132 and the first contact 131 in sequence, causing a diaphragm of the audio unit to vibrates to make sound.

In a technical solution of the present disclosure, the basket body 1 includes the plastic portion 12 and the metal portion 11. A plastic material of the plastic portion may insulate and protect a conducting circuit coupled to the conductive member 13, and the metal portion 11 may ensure an overall heat dissipation performance of the basket body 1. Compared with a solution of using a plastic basket or a metal basket in a related art, the technical solution of the present disclosure may achieve both the heat dissipation performance and the insulation performance.

As shown in FIGS. 1 to 3, the metal portion 11 may include a notch, a part of the plastic portion 12 is embedded in the notch, and the plastic portion 12 and the metal portion 11 may be enclosed to form a basket body 1 arranged in a ring shape. The basket body 1 may be arranged around the voice coil. The other part of the plastic portion 12 may be located outside the notch, and the plastic portion 12 and the metal portion 11 are arranged along an axial direction of the basket body 1. The circuit board 2 may be coupled to the part of the plastic portion 12 outside the notch, and the circuit board 2 may be configured to be conducted to the target circuit, so as to achieve signal transmission. In this embodiment, since the circuit board 2 is physically coupled to the plastic portion 12 in structure, a part of the plastic portion 12 may protrude from the notch. In other embodiments, the plastic portion 12 also may just fill the notch, and an end surface of the plastic portion 12 is flush with an end surface of the metal portion 11, which is not limited in the present disclosure.

There may be a plurality of positional relationships between the metal portion 11 and the plastic portion 12, and exemplary descriptions will be made as follows.

In an embodiment, as still shown in FIGS. 1 to 3, the notch of the metal portion 11 may include a first notch and a second notch, and the metal portion 11 may include a first metal portion 111 and a second metal portion 112, and the first metal portion 111 and the second metal portion 112 are symmetrically arranged. The first metal portion 111 include a first end and a second end, the second metal portion 112 include a first end and a second end. First ends of the first metal portion 111 and the second metal portion 112 are correspondingly arranged to form the first notch, and second ends of the first metal portion 111 and the second metal portion 112 are correspondingly arranged to form the second notch. The plastic portion 12 may include a first plastic portion 121 and a second plastic portion 122 symmetrically arranged with respect to a symmetry axis of the basket body 1. The first plastic portion 121 is partially embedded in the first notch, and the second plastic portion 122 is partially embedded in the second notch. The conductive member 13 may be embedded in the first plastic portion 121 or the second plastic portion 122. The circuit board 2 may be coupled to the first plastic portion 121 or the second plastic portion 122 in which the conductive member 13 is embedded. Based on this, since the diaphragm of the audio unit is coupled to the basket body 1, the symmetrical arrangement of the first plastic portion 121 and the second plastic portion 122 is conducive to ensuring the vibration balance of the audio unit equipped with the basket assembly 100. Moreover, it should be understood that the conductive member 13 is embedded in the first plastic portion 121, and since the conductive member 13 has a certain mass, a conductive member 13 also may be embedded in the second plastic portion 122 in order to balance the vibration of the audio unit, and the conductive member 13 embedded in the second plastic portion 122 and the conductive member 13 embedded in the first plastic portion 121 are arranged symmetrically to maintain a mass balance.

In this embodiment, the first plastic portion 121 may include a first surface and a second surface away from the first surface along the axial direction of the basket body 1.

The first contact 131 of the conductive member 13 is flush with the first surface, and the second contact 132 is flush with the second surface, so as to avoid a short circuit caused by the protrusion of the first contact 131 or the second contact 132. On the other hand, when the circuit board 2 is subsequently coupled to the first plastic portion 121, such flush arrangement may avoid unevenness after connection with the circuit board 2.

In another embodiment, the metal portion 11 may also include one notch. The metal portion 11 may be formed around the axial direction of the basket body 1, and the two ends of the metal portion are correspondingly arranged to form the notch. The basket assembly 100 may also include a single plastic portion. The single plastic portion may be partially embedded in the notch, or just fill the notch and an end face of the single plastic portion is flush with an end face of the metal portion, which is not limited in the present disclosure. When the basket assembly 100 includes a single plastic portion, the conductive member 13 is arranged on the single plastic portion 12. Similarly, the first plastic portion 121 may include a first surface and a second surface away from the first surface along the axial direction of the basket body 1. The first contact 131 of the conductive member 13 is flush with the first surface, and the second contact 132 is flush with the second surface, so as to avoid a short circuit caused by the protrusion of the first contact 131 or the second contact 132. On the other hand, when the circuit board 2 is subsequently coupled to the first plastic portion 121, such flush arrangement may avoid unevenness after connection with the circuit board 2.

Figure 6:
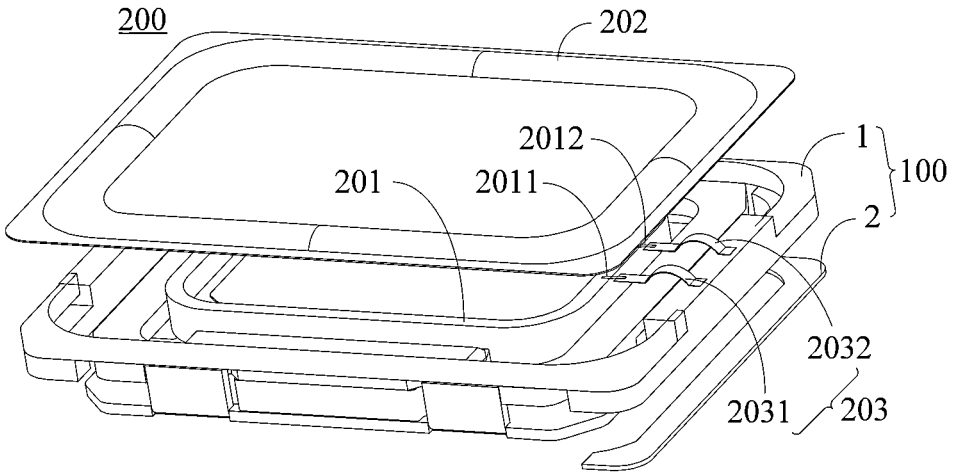
FIG. 6 is a schematic view showing an audio unit according to an embodiment.
Figure 7:
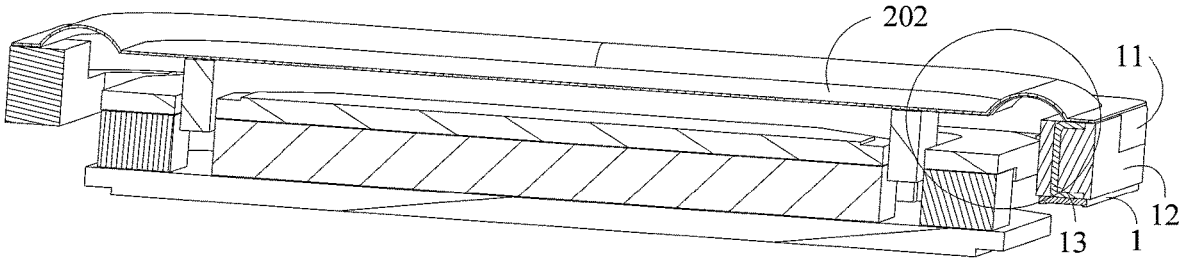
FIG. 7 is a cross-sectional view of the audio unit in FIG. 6.
Figure 8:
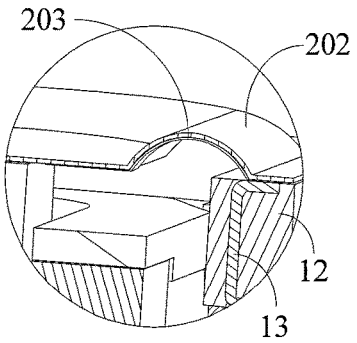
FIG. 8 is a partially enlarged view in FIG. 7.

The structure of the basket assembly 100 described in the foregoing embodiments may be applied to the audio unit 200 shown in FIGS. 6 to 8. The audio unit 200 may include a voice coil 201, a basket assembly 100, a diaphragm 202, and a conductive path 203. The basket body 1 of the basket assembly 100 may surround the voice coil 201, and a same side of the diaphragm 202 may be coupled to the voice coil 201 and the basket body 1, respectively. The conductive path 203 may be arranged on a surface of the diaphragm 202 facing the voice coil. One end of the conductive path 203 may be electrically coupled to the voice coil 201 and the other end may be electrically conducted to the first contact 131 of the conductive member 13. The audio unit 200 may include a speaker subunit or a receiver subunit.

It should be understood that the voice coil 201 of the audio unit 200 is formed by winding wires. Thus, the voice coil 201 may generally include a first lead end 2011 and a second lead end 2012. In order to electrically couple the first lead end 2011 with the second lead end 2012 to form a loop, the conductive path 203 may include a first conductive path 2031 and a second conductive path 2032, and the conductive member 13 may include a first conductive member 133 and a second conductive member 134. The first contact 131 of the first conductive member 133 may be electrically coupled to the first lead end 2011 of the voice coil 201 through the first conductive path 2031. Specifically, one end of the first conductive path 2031 may be electrically coupled to the first lead end 2011 and the other end may be conducted to the first contact 131 of the first conductive member 133. Similarly, the first contact 131 of the second conductive member 134 may be electrically coupled to the second lead end 2012 of the voice coil 201 through the second conductive path 2032. Specifically, one end of the second conductive path 2032 may be electrically coupled to the second lead end 2012, and the other end may be conducted to the first contact 131 of the second conductive member 134. The second contact 132 of the first conductive member 133 may be electrically coupled to a positive terminal of the target circuit through the circuit board 2, and the second contact 132 of the second conductive member 134 may be electrically coupled to a negative terminal of the target circuit through the circuit board 2.

In this way, from the positive terminal of the target circuit, an audio signal may be transmitted to the negative terminal of the target circuit in sequence via the second contact 132 of the first conductive member 133, the first contact 131 of the first conductive member 133, the first conductive path 2031, the first lead end 2011, the second lead end 2012, the second conductive path 2032, the first contact 131 of the second conductive member 134, and the second contact 132 of the second conductive member 134. Certainly, in other embodiments, the second contact 132 of the first conductive member 133 may be electrically coupled to the negative terminal of the target circuit through the circuit board 2, and the second contact 132 of the second conductive member 134 may be electrically coupled to the positive terminal of the target circuit through the circuit board 2, which is not limited in the present disclosure. In this embodiment, the first conductive member 133 and the second conductive member 134 may be symmetrically arranged on the plastic portion 12 with respect to the symmetry axis of the basket body 1, which is conducive to the first conductive path 2301 and the second conductive path 2302, respectively conducted by the first conductive member 133 and the second conductive member 134, to be arranged symmetrically with respect to the diaphragm 202, thereby ensuring the vibration balance of the audio unit 200. Certainly, in order to further improve the balance of vibration, a third conductive path and a fourth conductive path may also be arranged on the diaphragm 202. The third conductive path and the first conductive path 2031 are centrosymmetrically arranged with respect to center of symmetry of the audio unit 200. The fourth conductive path and the second conductive path 2032 are centrosymmetrically arranged with respect to center of symmetry of the audio unit 200.

In the foregoing embodiment, the first conductive member 133 and the second conductive member 134 may be of various structural configurations. The following is an exemplary description of structure of the conductive member included in the basket assembly 100, taking the first conductive member 133 as an example. In an embodiment, for example, the first conductive member 133 may be arranged in a cylindrical shape, and the first contact 131 and the second contact 132 may be provided at two ends of the first conductive member 133 arranged in a cylindrical shape, respectively. In another embodiment, the first conductive member 133 may be arranged in a strip shape, and the first contact 131 and the second contact 132 may be provided at two ends of the first conductive member 133 arranged in the strip shape respectively. In yet another embodiment, as shown in FIG. 2, the first conductive member 133 may include a connection portion, a first extension portion coupled to one end of the connection portion, and a second extension portion coupled to the other end of the connection portion. The connection portion may be arranged along the axial direction of the basket body 1. The first extension portion extends from one end of the connection portion along a radial direction of the basket body 1, and the second extension portion extends from the other end of the connection portion along the radial direction of the basket body 1. One surface of the first extension portion may be flush with the surface of the plastic portion 12 to form the first contact 131, and one surface of the second extension portion may be flush with the surface of the plastic portion 12 to form the second contact 132. Thus, the radial extension of the first extension portion and the radial extension of the second extension portion are conductive to increasing contact area of the first contact 131 and the second contact 132 and improving reliability of the electric conduction of the conductive member 13.

It should be noted that the above description is made by taking the first conductive member 133 including the connection portion, the first extension portion, and the second extension portion as an example. In fact, in other embodiments, the first conductive member may also include a connection portion and a first extension portion; or the first conductive member may include a connection portion and a second extension portion, and thus an end of the connection portion may be configured as a contact. The above description only takes the first conductive member 133 as an example, the structure of the second conductive member 134, may refer to the first conductive member 133, and the structure of the second conductive member 134 may be the same as or different from the first conductive member 133. When the basket assembly 100 further includes other conductive members, their structures may also refer to the first conductive member 133, which will not be repeated here.

The above embodiments are all described by taking the basket assembly 100 including the basket body 1 and the circuit board 2 as an example. In other embodiments, as shown in FIGS. 9 and 10, the basket assembly 100 may not include the circuit board 2, and the circuit board 2 may be configured as a separate part to be subsequently coupled to the basket body 1 and also conducted to the first contact 131 and the second contact 132 of the conductive member 13.

Figure 9:
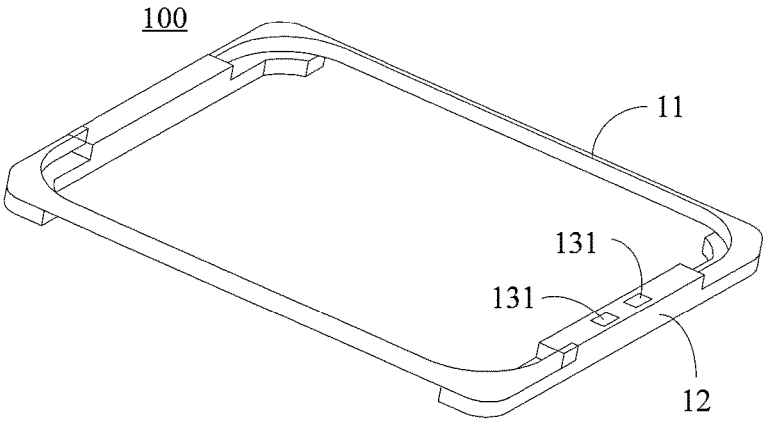
FIG. 9 is a schematic view showing another basket assembly according to an embodiment.
Figure 10:
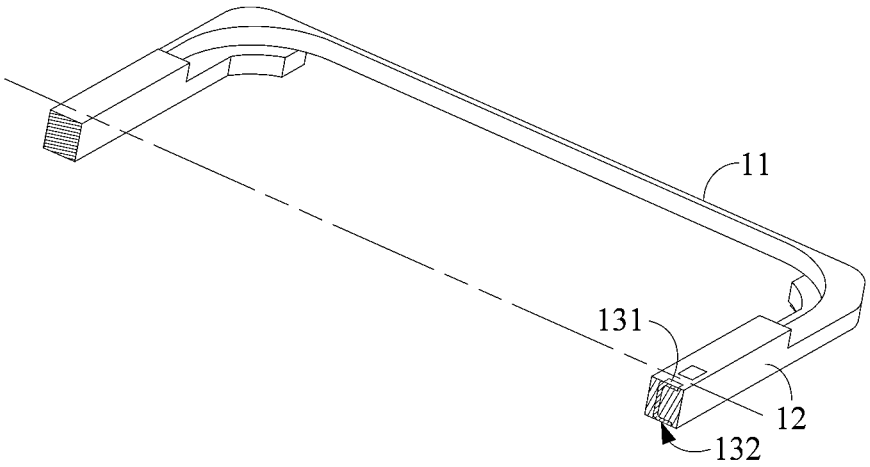
FIG. 10 is a cross-sectional view of the basket assembly in FIG. 9.

The present disclosure further provides an audio unit, including the basket assembly 100 shown in FIGS. 9 and 10.

According to the foregoing embodiments, the present disclosure further provides an electronic device. The electronic device may include a housing and the audio unit 200 as described in any of the foregoing embodiments. The housing may include a sound outlet, the audio unit 200 may be arranged in the housing, and the diaphragm 202 is arranged facing the sound outlet to cause air vibration when the diaphragm 202 vibrates, and then sound may be transmitted through the sound outlet.

Other implementations of the present disclosure will be apparent to the skilled in the art after considering the specifications and practicing the application disclosed here. This application is therefore intended to cover any variations, uses, or adaptations of the present disclosure. These variations, uses, or adaptations follow the general principles of the present disclosure and include common general knowledge or conventional technical means in the art that are not disclosed in the present disclosure. The specification and embodiments are considered exemplary only. The true scope and spirit of the present disclosure should be indicated by the appended claims.

It should be understood that, the present disclosure is not limited to accuracy structures described above and illustrated in the accompanying drawings, and may perform various modification and changes without departing from the scope of the present disclosure. The scope of the present disclosure is merely limited by the appended claims.

What is claimed is:

1. A basket assembly applied to an audio unit with a voice coil, comprising a basket body, wherein the basket body comprises:

a metal portion, a plastic portion coupled to the metal portion; and a conductive member embedded in the plastic portion, and forming a first contact and a second contact exposed out of the plastic portion, the first contact being configured to be electrically coupled to the voice coil of the audio unit, the second contact being configured to be electrically coupled to a target circuit, the target circuit comprising an audio signal input circuit or an audio signal output circuit, wherein the plastic portion comprises a first surface and a second surface, the second surface being away from the first surface along an axial direction of the basket body, the first contact is flush with a first surface of the plastic portion, and the second contact is flush with a second surface of the plastic portion.

2. The basket assembly according to claim 1, wherein the metal portion comprises a notch, and the plastic portion is at least partially embedded in the notch to form the basket body arranged in a ring shape.

3. The basket assembly according to claim 2, wherein the metal portion includes a first metal portion and a second metal portion, the notch includes a first notch and a second notch, first ends of the first metal portion and the second metal portion are correspondingly arranged to form the first notch, and second ends of the first metal portion and the second metal portion are correspondingly arranged to form the second notch;

the plastic portion comprises a first plastic portion and a second plastic portion symmetrically arranged, the first plastic portion is at least partially embedded in the first notch, the second plastic portion is at least partially embedded in the second notch, and the conductive member is embedded in the first plastic portion or the second plastic portion.

4. The basket assembly according to claim 1, wherein the conductive member comprises a first conductive member and a second conductive member, a first contact of the first conductive member is configured to be coupled to a first lead end of the voice coil, a first contact of the second conductive member is configured to be coupled to a second lead end of the voice coil, a second contact of one of the first conductive member and the second conductive member is coupled to a positive terminal of the target circuit, and a second contact of the other one of the first conductive member and the second conductive member is coupled to a negative terminal of the target circuit.

5. The basket assembly according to claim 4, wherein at least one of the first conductive member and the second conductive member is arranged in a cylindrical shape.

6. The basket assembly according to claim 4, wherein at least one of the first conductive member and the second conductive member is arranged in a strip shape.

7. The basket assembly according to claim 4, wherein the metal portion and the plastic portion are coupled to form the basket body arranged in a ring shape, and the first conductive member and the second conductive member are arranged symmetrically with respect to a symmetry axis of the basket body.

8. The basket assembly according to claim 2, wherein the plastic portion is partially arranged outside the notch, and the plastic portion and the metal portion are stacked along an axial direction of the basket body, the basket assembly further comprises:

a circuit board coupled to a part of the plastic portion outside the notch, the second contact being coupled to the circuit board, the circuit board being conducted to the target circuit.

9. The basket assembly according to claim 2, wherein the conductive member comprises at least one of a first extension portion and a second extension portion, and a connection portion, the connection portion is arranged along the axial direction of the basket body, the first extension portion extends from one end of the connection portion along a radial direction of the basket body, the second extension portion extends from the other end of the connection portion along the radial direction of the basket body, a surface of the first extension portion is flush with the plastic portion to form the first contact, and a surface of the second extension portion is flush with the plastic portion to form the second contact.

10. The basket assembly according to claim 1, wherein the conductive member and the plastic portion are injection-molded.

11. An audio unit, comprising a voice coil;

a basket assembly applied to an audio unit with a voice coil, comprising a basket body, and the basket body comprising:

a metal portion, a plastic portion coupled to the metal portion; and a conductive member embedded in the plastic portion, and forming a first contact and a second contact exposed out of the plastic portion, the first contact being configured to be electrically coupled to the voice coil of the audio unit, the second contact being configured to be electrically coupled to a target circuit, the target circuit comprising an audio signal input circuit or an audio signal output circuit; the basket body of the basket assembly being arranged around the voice coil;

a diaphragm, a same side of the diaphragm being coupled to the basket body and the voice coil, respectively; and a conductive path arranged on a surface of the diaphragm facing the voice coil, one end of the conductive path being electrically coupled to the voice coil, the other end being conducted to the first contact of the conductive member.

12. The audio unit according to claim 11, wherein the conductive member comprises a first conductive member and a second conductive member; the conductive path comprises a first conductive path and a second conductive path spaced apart from each other on the surface of the diaphragm; the first conductive path conducts the first lead end of the voice coil with the first contact of the first conductive member, and the second conductive path conducts the second lead end of the voice coil with the first contact of the first conductive member; the second contact of one of the first conductive member and the second conductive member is coupled to a positive terminal of the target circuit, and the second contact of the other is coupled to a negative terminal of the target circuit.

13. The audio unit according to claim 11, wherein the audio unit comprises a speaker subunit or a receiver subunit.

14. The audio unit according to claim 11, wherein the metal portion comprises a notch, and the plastic portion is at least partially embedded in the notch to form the basket body arranged in a ring shape.

15. The audio unit according to claim 14, wherein the metal portion includes a first metal portion and a second metal portion, the notch includes a first notch and a second notch, first ends of the first metal portion and the second metal portion are correspondingly arranged to form the first notch, and second ends of the first metal portion and the second metal portion are correspondingly arranged to form the second notch;

the plastic portion comprises a first plastic portion and a second plastic portion symmetrically arranged, the first plastic portion is at least partially embedded in the first notch, the second plastic portion is at least partially embedded in the second notch, and the conductive member is embedded in the first plastic portion or the second plastic portion.

16. The audio unit according to claim 14, wherein the plastic portion comprises a first surface and a second surface away from the first surface along an axial direction of the basket body, the first contact is flush with a first surface of the plastic portion, and the second contact is flush with a second surface of the plastic portion.

17. The audio unit according to claim 11, wherein the conductive member comprises a first conductive member and a second conductive member, a first contact of the first conductive member is configured to be coupled to a first lead end of the voice coil, a first contact of the second conductive member is configured to be coupled to a second lead end of the voice coil, a second contact of one of the first conductive member and the second conductive member is coupled to a positive terminal of the target circuit, and a second contact of the other one of the first conductive member and the second conductive member is coupled to a negative terminal of the target circuit.

18. The audio unit according to claim 17, wherein the metal portion and the plastic portion are coupled to form the basket body arranged in a ring shape, and the first conductive member and the second conductive member are arranged symmetrically with respect to a symmetry axis of the basket body.

19. An electronic device, comprising a housing comprising a sound outlet; and an audio unit arranged in the housing, wherein the audio unit comprises:

a voice coil;

a basket assembly applied to an audio unit with a voice coil, comprising a basket body, and the basket body comprising:

a metal portion, a plastic portion coupled to the metal portion; and a conductive member embedded in the plastic portion, and forming a first contact and a second contact exposed out of the plastic portion, the first contact being configured to be electrically coupled to the voice coil of the audio unit, the second contact being configured to be electrically coupled to a target circuit, the target circuit comprising an audio signal input circuit or an audio signal output circuit; the basket body of the basket assembly being arranged around the voice coil;

a diaphragm, a same side of the diaphragm being coupled to the basket body and the voice coil, respectively; and a conductive path arranged on a surface of the diaphragm facing the voice coil, one end of the conductive path being electrically coupled to the voice coil, the other end being conducted to the first contact of the conductive member;

wherein the diaphragm is arranged to face the sound outlet.

* * * * *